US007299773B2

(12) United States Patent
Hoche et al.

(10) Patent No.: US 7,299,773 B2
(45) Date of Patent: Nov. 27, 2007

(54) CYLINDER FOR A TWO STROKE ENGINE

(75) Inventors: Florian Hoche, Waiblingen (DE); Niels Kunert, Sindelfingen (DE); Horst Denner, Weinstadt (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/308,721

(22) Filed: Apr. 26, 2006

(65) Prior Publication Data

US 2007/0034181 A1 Feb. 15, 2007

(30) Foreign Application Priority Data

Apr. 27, 2005 (DE) ..... 10 2005 019 520

(51) Int. Cl.
*F02B 33/04* (2006.01)
*F02B 25/00* (2006.01)
*F02F 1/22* (2006.01)

(52) U.S. Cl. ..... 123/73 PP; 123/65 A

(58) Field of Classification Search ..... 123/73 PP, 123/65 A, 65 P, 74 R
See application file for complete search history.

(56) References Cited

U.S. PATENT DOCUMENTS 4,414,928 A * 11/1983 Nakada ..... 123/73 PP
5,040,496 A 8/1991 Plohberger et al.
7,025,021 B1 * 4/2006 Andersson et al. ..... 123/73 PP
7,100,550 B2 * 9/2006 Sheldon et al. ..... 123/65 P

* cited by examiner

*Primary Examiner*—Stephen K. Cronin
*Assistant Examiner*—Hyder Ali
(74) *Attorney, Agent, or Firm*—Gudrun E. Huckett

(57) ABSTRACT

A cylinder for a two-stroke engine has a cylinder wall defining a cylinder interior. A cylinder head closes of a combustion chamber in the cylinder interior. An exhaust is connected to the cylinder interior. At least one transfer passage having a transfer port opens into the cylinder interior. The at least one transfer passage is disposed in the cylinder wall for connecting a crank case of the two-stroke engine to the combustion chamber. The at least one transfer passage has at the level of the transfer port at least one flow deflecting rib having a radial spacing from the transfer port in a radial outward direction relative to a longitudinal cylinder axis.

17 Claims, 3 Drawing Sheets

Fig. 6
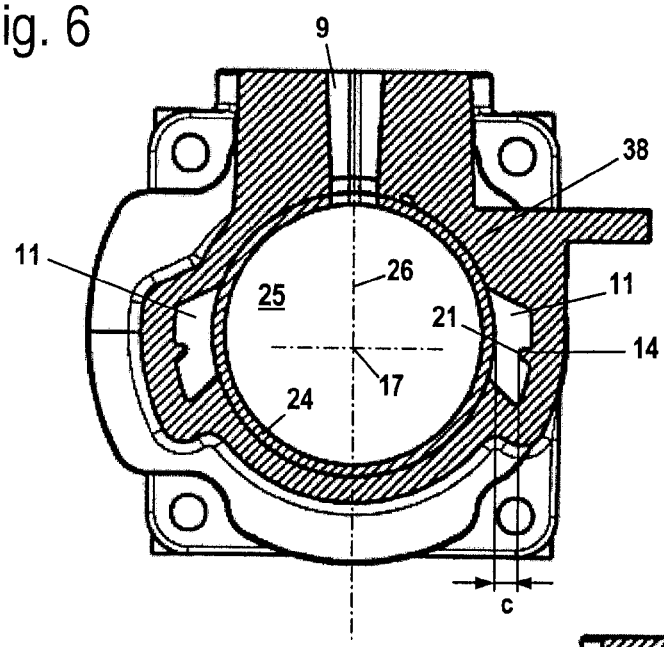
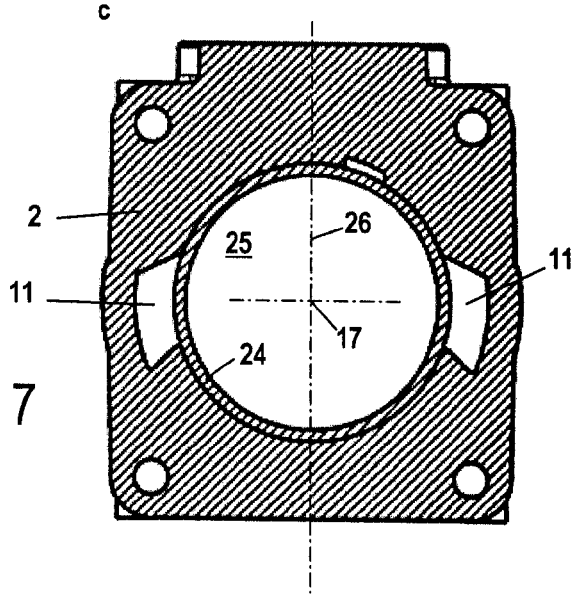
Fig. 7
Fig. 8
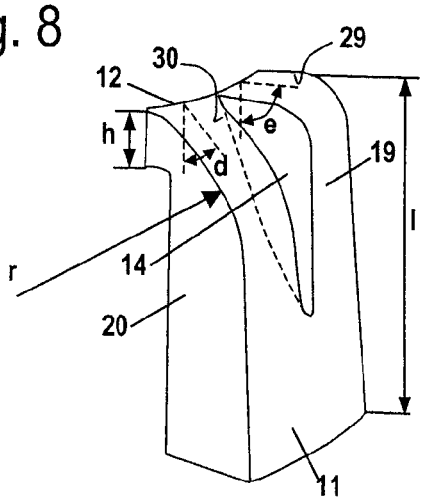
Fig. 9
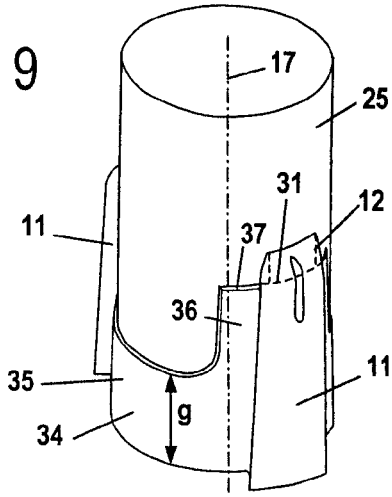

CYLINDER FOR A TWO STROKE ENGINE

BACKGROUND OF THE INVENTION

The invention relates to a cylinder for a two-stroke engine, in particular, a scavenging two-stroke engine, of a hand-guided power tool such as a motor chain saw, a cut-off machine, a trimmer or the like.

U.S. Pat. No. 5,040,496 discloses a cylinder of a two-stroke engine having a cylinder wall provided with transfer passages. In the area adjoining the transfer ports flow deflecting vanes are provided in the transfer passages that can have a honeycomb or grid structure. The vanes extend up to the transfer port. The vanes are inserted as a separate component into the transfer passage and requires therefore an additional assembly step and represent additional components. When the vanes are made to be thin, they have only a minimal mechanical stability or strength. When they are configured to be thicker or stronger, the vanes reduce the flow cross-section in the transfer port so that the quantity of air supplied to the combustion chamber is reduced. Enlarging the transfer ports is not easily possible because of the spatial conditions present at the cylinder, in particular, because of timing. When the transfer ports are displaced in the direction toward the exhaust, the exhaust gas values will worsen because the combustion chamber scavenging is worsened and the fresh mixture can flow directly into the exhaust.

SUMMARY OF THE INVENTION

It is an object of the present invention to provide a cylinder for a two-stroke engine that can be manufactured in a simple way and that enables operation of the two-stroke engine at minimal exhaust gas values.

In accordance with the present invention, this is achieved in that the cylinder has a cylinder wall surrounding a cylinder interior; a cylinder head that closes off the cylinder at the side of the combustion chamber; and an exhaust from the cylinder interior, wherein at least one transfer passage for connecting the crank case of the two-stroke engine to the combustion chamber is provided in the cylinder wall, wherein the transfer passage opens with a transfer port into the cylinder interior, and wherein the transfer passage at the level of the transfer port has at least one flow deflecting rib that is positioned at a spacing from the transfer port in a radial direction relative to a longitudinal cylinder axis.

Because the flow deflecting rib does not extend all the way to the transfer port, the surface area of the transfer port is not reduced. In the radially outwardly positioned area of the transfer passage, the passage can be wider so that sufficiently large flow cross-sections can be realized. The flow deflecting rib can be designed to be comparatively solid (thick) so that a sufficient mechanical stability or strength is provided. By means of the flow deflecting rib the angles at which the scavenging air and the mixture flow into the combustion chamber can be freely selected within a wide range so that excellent scavenging results and therefore minimal exhaust gas values are obtainable. Because the flow deflecting rib does not project all the way to the transfer port, the flow deflecting rib can be used also in cylinders for small size engines in which, as a result of the limited space conditions, the arrangement of two separate transfer passages is not possible. Because the flow deflecting rib does not project all the way to the transfer port, the two sections (branches) of the transfer passage are connected to one another so that a pressure compensation between both sections of the transfer passage takes place. In this way, when filling the transfer passage with substantially fuel-free air, a uniform filling of the sections of the transfer passage is achieved. A uniform filling of the transfer passage results also when the top edge in the transfer port is not positioned perpendicularly to the longitudinal cylinder axis. In this way, the geometry of the transfer port can be adjusted easily for an excellent scavenging behavior of the combustion chamber without this causing limitations of the geometry because of scavenging.

Preferably, the flow deflecting rib extends from the radially outwardly positioned wall of the transfer passage (relative to the longitudinal cylinder axis) into the transfer passage. The connection to the radially outwardly positioned wall of the transfer passage provides that the flow deflecting rib is connected across its entire length to the cylinder and has therefore great stability. Since the radially outwardly positioned area of the transfer passage is divided by the flow deflecting rib, on either side of the flow deflecting rib different courses of the radially outwardly positioned wall of the transfer passage can be realized so that the intake angles into the combustion chamber can be easily adjusted as needed.

In particular, the flow deflecting rib is oriented in the direction of the longitudinal cylinder axis. This alignment or orientation of the flow deflecting rib enables an intake direction into the combustion chamber that effects excellent scavenging of the combustion chamber. The edge of the flow deflecting rib projecting into the transfer passage extends preferably relative to the longitudinal cylinder axis at an angle defined by two intersecting lines tapering in the direction toward the cylinder head. The flow deflecting rib projects therefore with its end remote from the cylinder head not as far into the transfer passage as with its end proximal to the cylinder head. In this way, the flow in the transfer passage for a flow direction into the combustion chamber is divided gradually into two sections or branches. This prevents turbulences or swirls so that sufficient quantities of air and mixture can be supplied to the combustion chamber through the transfer passage. The flow deflecting rib extends in particular across the entire height of the transfer port. Preferably, the flow deflecting rib extends across more than one third, in particular, more than half of the length of the transfer passage measured parallel to the longitudinal cylinder axis. Since the flow deflecting rib extends across a significant portion of the length of the transfer passage, the influence on the flow direction can be realized gradually so that minimal flow resistance will result.

It is provided that the flow deflecting rib divides the transfer passage into two branches that are connected to one another. Beneficial flow conditions result when the top wall of one branch of the transfer passage is positioned relative to the longitudinal cylinder axis at a different angle than the top wall of the other branch of the transfer passage. Preferably, the top wall of the exhaust-proximal branch of the transfer passage has an angle of at least 80 degrees relative to the longitudinal cylinder axis. It is provided that the top wall of the exhaust-remote branch of the transfer passage extends at a radius and opens at an angle of 25 degrees to 60 degrees into the interior of the cylinder. The flow deflecting rib enables a freely selectable design of the intake angle into the combustion chamber. In this way, by means of a single transfer passage intake conditions can be obtained that are usually obtainable only by arranging two separate transfer passages. Preferably, the exhaust-remote wall of the transfer passage is positioned at an angle of 55 degrees to 75 degrees relative to a center plane that divides the exhaust at the level of the transfer port. The exhaust-remote surface of the flow deflecting rib is positioned at an angle of expediently 60 degrees to 115 degrees to the center plane dividing the exhaust at the level of the transfer port. For the exhaust-proximal surface of the flow deflecting rib, an angle of 35 degrees to 65 degrees is expediently selected relative to the center plane dividing the exhaust at the level of the transfer port. The exhaust-poximal wall of the transfer passage is positioned expediently at an angle of 30 degrees to 60 degrees relative to the center plane dividing the exhaust at the level of the transfer port. It was found that by appropriately selecting the angles in this area beneficial flow conditions can be obtained so that the exhaust gases can be properly scavenged from the combustion chamber and a transfer of fresh mixture into the exhaust can be substantially prevented at the same time.

A simple manufacture of the cylinder can be achieved in that the flow deflecting rib is cast as a monolithic part of the cylinder. The flow deflecting rib can therefore be produced in the same manufacturing step as the cylinder itself. For a simple manufacture of the cylinder it is moreover provided that in the cylinder bore a cylinder lining is arranged that separates the transfer passage across at least one section of its length from the cylinder interior. In this way, the transfer passage can be closed relative to the cylinder interior without this requiring the use of a core when manufacturing the transfer passage by a casting process. The cylinder lining extends in particular to the bottom edge of the transfer port. Because the cylinder lining does not extend across the entire length of the cylinder, the transfer ports must not be introduced as openings into the cylinder lining. In this way, the manufacture of the cylinder lining is simplified. Also, the exhaust that is positioned usually at the level of the transfer ports does not require an additional opening in the cylinder lining. In particular, the cylinder lining is configured at the end facing away from the cylinder head as a closed ring whose height is less than two thirds, preferably less than half, of the length of the transfer passage. The cylinder lining can thus be manufactured in a material-saving way. Also, in the area of the mixture intake into the crank case of the two-stroke engine, the cylinder lining can be provided with a cutout so that no opening must be manufactured in the cylinder lining for providing the intake. It is provided that the cylinder lining in the area of the transfer passage has a web that extends, starting at the ring, to the bottom edge of the transfer port and that separates the transfer passage from the interior of the cylinder. It is therefore possible to manufacture a closed transfer passage in a simply way.

Preferably, the cylinder has two oppositely arranged symmetrically configured transfer passages in which a flow deflecting rib is arranged, respectively. The center plane that divides the exhaust in particular centrally provides the plane of symmetry. In order to provide scavenging air in the transfer passage for separating the outgoing exhaust gases from the incoming fresh mixture, it is provided that in the cylinder at least one air passage for supplying air via a piston recess is formed in the transfer passage wherein the air passage opens at the cylinder bore. By means of the air passage and the piston recess, a piston-controlled connection between the air passage and the transfer passage can be provided that can be manufactured in a simple way.

BRIEF DESCRIPTION OF THE DRAWING

FIG. 6 is a section along the section line VI-VI of FIG. 2.

FIG. 7 is a section along the section line VII-VII of FIG. 2.

FIG. 8 is a schematic perspective illustration of a transfer passage.

FIG. 9 is a schematic perspective illustration of a cylinder interior with transfer passages.

DESCRIPTION OF THE PREFERRED EMBODIMENTS

Figure 1:
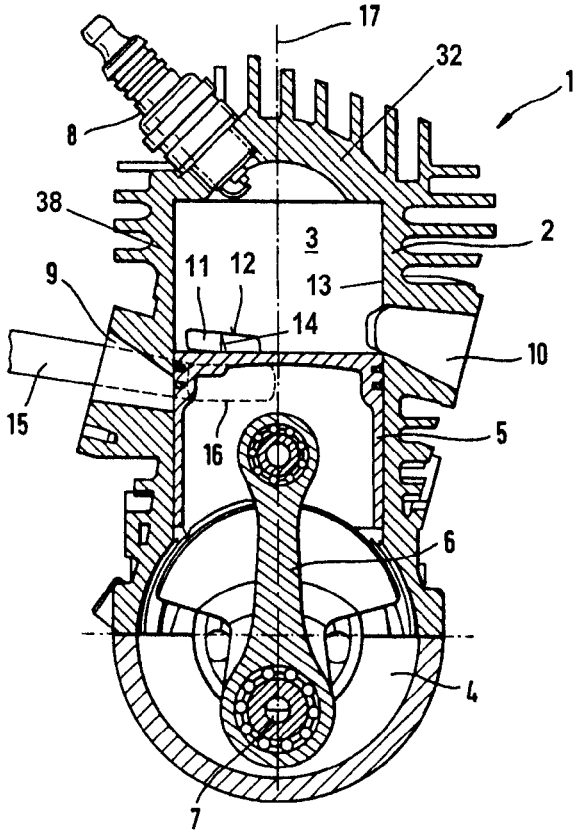
FIG. 1 is a schematic section illustration of a two-stroke engine.

The two-stroke engine 1 illustrated in FIG. 1 has a cylinder 2 with a cylindrical cylinder bore 13 in which a piston 5 is supported sp as to move reciprocatingly. The cylinder 2 is closed at one end by a cylinder head 32. The piston 5 delimits together with the cylinder bore 13 and the cylinder head 32 a combustion chamber 3 of the two-stroke engine 1. The cylinder head 32 is penetrated by a spark plug 8 that ignites the mixture in the combustion chamber 3. The piston 5 is supported in the cylinder 2 so as to reciprocate in the direction of the longitudinal cylinder axis 17 and drives by means of connecting rod 6 the crankshaft 7 that is rotatably supported in the crank case 4. The crank case 4 is arranged on the side of the cylinder 2 opposite the cylinder head 32. An intake 9 opens at the cylinder bore 13 and feeds a fuel/air mixture into the crank case 4 when the piston 5 is in the area of the top dead center. An exhaust 10 extends away from the combustion chamber 3 and is piston-controlled by the piston 5 like the intake 9.

The cylinder 2 has two transfer passages 11 provided in the cylinder wall 38; FIG. 1 shows only one of them. The second transfer passage is positioned opposite and symmetric to the first transfer passage 11. In the area of the bottom dead center of the piston 5, the transfer passages 11 connect the crank case 4 to the combustion chamber 3. In this connection, the transfer passages 11 open with a transfer port 12 into the combustion chamber 3. In the area of the top dead center of the piston 5, the transfer ports 12 are connected by piston recesses (not illustrated in FIG. 1) provided within the piston 5 to an air passage 15 that is provided within the cylinder 2. The air passage 15 opens at an air passage port 16 below the transfer port 12 at the cylinder bore 13.

In operation of the two-stroke engine 1, in the area of the upper dead center of the piston 5 substantially fuel-free air flows from the air passage 15 through piston recesses, not illustrated, through the transfer ports 12 into the transfer passage 11. Beginning at the combustion chamber end, the transfer passages 11 are filled with substantially fuel-free air. Fuel/air mixture flows through the intake 9 into the crank case 4. Upon downward stroke of the piston 5, the mixture in the crank case 4 is compressed. As soon as the transfer ports 12 open, first the substantially fuel-free air contained in the transfer passages 11 flows into the combustion chamber 3 and scavenges the exhaust gases of the previous cycle out of the combustion chamber 3 through the exhaust 10. Subsequently, fuel/air mixture flows through the transfer passages 11 into the combustion chamber 3. Upon upward stroke of the piston 5, the mixture in the combustion chamber 3 is compressed again and ignited by the spark plug 8 when the piston 5 is in the area of the upper dead center. As a result of combustion, the piston 5 is accelerated in the direction toward the crank case 4. The exhaust gases flows through the exhaust 10 and are scavenged by the air that passes through the transfer passages 11 into the combustion chamber 3.

Figure 2:
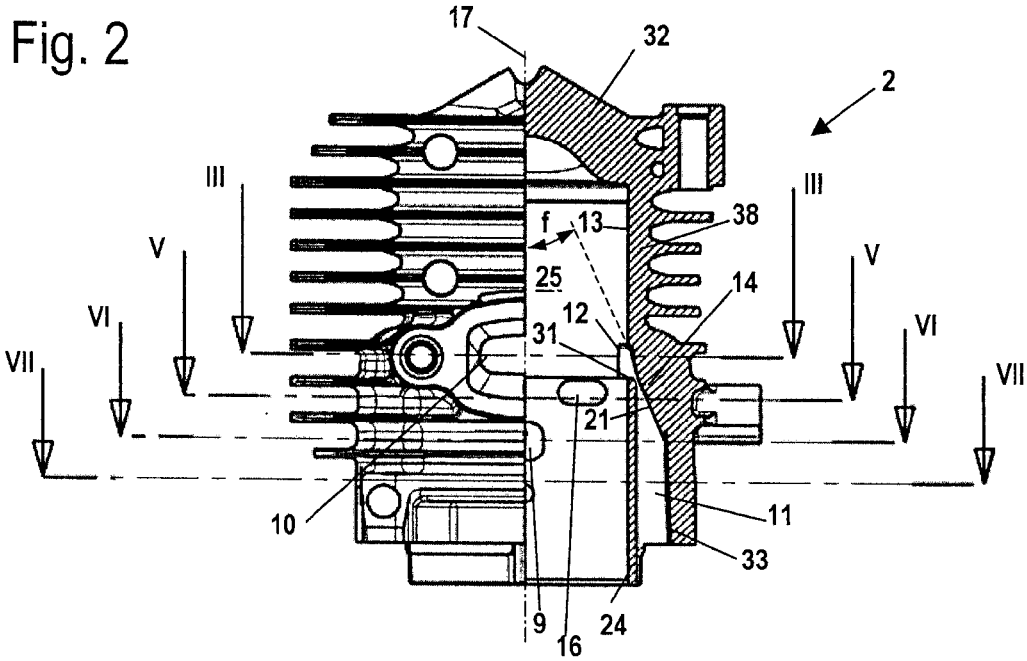
FIG. 2 shows the cylinder of a two-stroke engine in a partial section view.

At the level of the transfer port 12 a flow deflecting rib 14 is arranged in the transfer passage 11. In FIG. 2, the flow deflecting rib 14 is shown in section. The flow deflecting rib 14 extends in the transfer passage 11 in the direction of the longitudinal cylinder axis 17. The edge 21 of the flow deflecting rib 14 projecting into the transfer passage 11 is inclined relative to the longitudinal cylinder axis 17 at an angle f defined by two intersecting lines tapering in a direction toward the cylinder head 32. Starting at the end of the transfer passage 11 that is facing the crank case 4 and is remote from the cylinder head 32, the width of the flow deflecting rib 14 measured radially relative to the longitudinal cylinder axis 17 therefore increases toward the end of the transfer passage 11 that is facing the combustion chamber 3 and is proximal to the cylinder head 32. The flow deflecting rib 14 illustrated in FIG. 2 extends with its edge 21 in a straight line; however, the edge 21 can also be curved or arc-shaped.

Beginning at the radially outwardly positioned wall 33 of the transfer passage 11, the flow deflecting rib 14 projects into the transfer passage 11. The flow deflecting rib 14 is thus secured to the radially outwardly positioned wall 33 as well as to the cylinder 2 in the area of the top wall of the transfer passage 11. The flow deflecting rib 14 is in particular cast as a monolithic part of the cylinder 2. As shown in FIG. 2, the flow deflecting rib 14 extends from the top wall of the transfer passage 11 across the entire height of the transfer port 12 to approximately the center of the transfer passage 11 where it passes into the radially outwardly positioned wall 33.

In the cylinder bore 13 a cylinder lining 24 is arranged that extends from the end of the cylinder 2 at the combustion chamber 3 to the bottom edge 31 of the transfer port 12. In this connection, the bottom edge 31 of the transfer port 12 is the edge that is proximal to the crank case 4 and remote from the cylinder head 32. The flow deflecting rib 14 ends at a spacing in front of the transfer port 12 so that it does not divide the transfer passage 11 completely but only in the radially outwardly positioned area into two branches that, however, are connected to one another in the radial inwardly positioned area of the transfer passage 11. Accordingly, the flow deflecting rib 14 does not reduce the flow cross-section within the transfer port 12.

Figure 3:
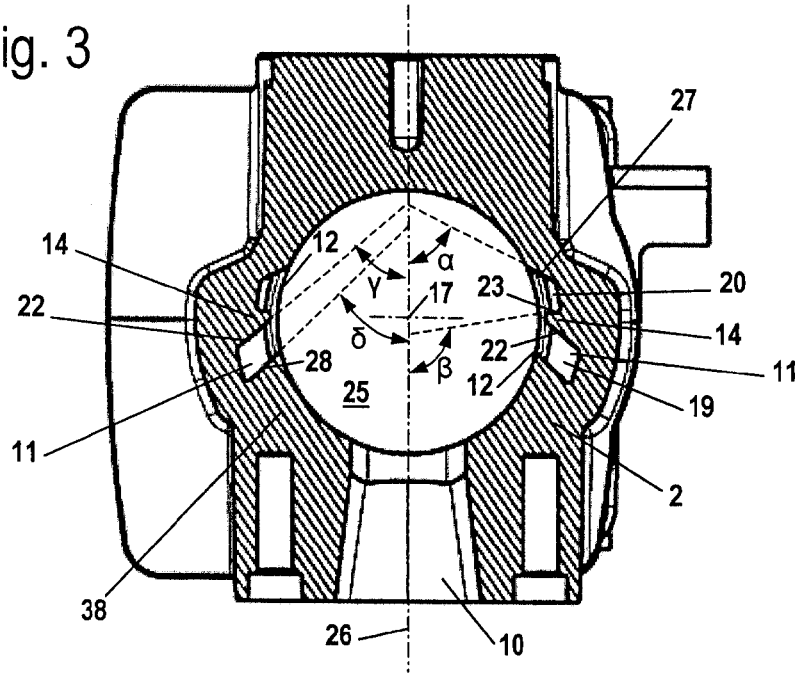
FIG. 3 is a section of the cylinder of FIG. 2 along the section line III-III of FIG. 2.
Figure 4:
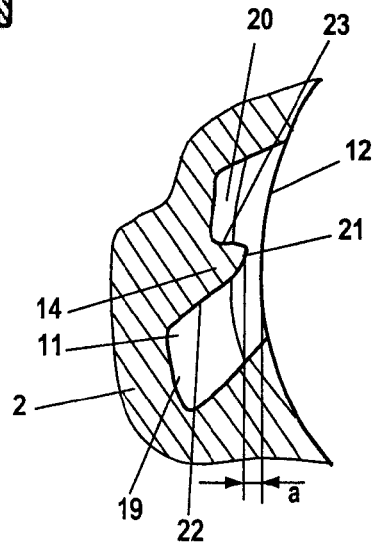
FIG. 4 is an enlarged detail view of a transfer passage of FIG. 3.

As shown in FIG. 3 in the section view at the level of the transfer port 12, the two transfer passages 11 are arranged symmetrically to a center plane 26 that divides the exhaust 10 centrally and that extends through the longitudinal cylinder axis 17. The flow deflecting ribs 14 in both transfer passages 11 are configured symmetrical to the center plane 26. At the level of the transfer port 12 the flow deflecting rib 14 divides the transfer passage 11 into a branch 19 proximal to the exhaust 10 and into a branch 20 remote from the exhaust 10. Both branches 19, 20 are connected to one another in the area of the transfer port 12. As illustrated in the enlarged detail view of FIG. 4, the edge 21 of the flow deflecting rib 14 projecting into the transfer passage 11 has a spacing a from the transfer port 12 so that the two branches 19, 20 are connected to one another at the level of the transfer port 12. This is so even when the transfer port 12 is still closed by the piston 5. The flow deflecting rib 14 ends thus at the spacing a in front of an imaginary extension of the wall of the cylinder bore 13 into the transfer port 12. The edge 21 of the flow deflecting rib 14 can be a pointed edge; however, the edge 21 is preferably a rounded edge. The flow deflecting rib 14 has two flow deflecting surfaces wherein the flow deflecting surface 22 is facing the exhaust-proximal branch 19 and the flow deflecting surface 23 is facing the exhaust-remote branch 20 of the transfer passage 11.

As shown in FIG. 3, the flow deflecting surfaces 22 and 23 as well as the walls of the transfer passages 11 are inclined at different angles relative to the center plane 26. In this way, beneficial flow conditions can be achieved during intake into the cylinder interior 25. The exhaust-remote wall 27 of the transfer passage 11 that delimits the exhaust-remote branch 20 has relative to the center plane 26 an angle a that is 55 degrees to 75 degrees. In this connection, the angle $\alpha$ is the angle between the center plane 26 and the extension of the wall 27 which angle opens toward the exhaust 10. The flow deflecting surface 23 that delimits the exhaust-remote branch 20 of the transfer passage 11 at its side proximal to the exhaust 10 is positioned at an angle $\gamma$ between 60 degrees and 115 degrees relative to the center plane 26. The angle $\gamma$ between the flow deflecting surface 22 and the exhaust-proximal branch 19 of the transfer passage 11 and the center plane 26 is expediently 35 degrees to 65 degrees. The exhaust-proximal wall 28 of the transfer passage 11 that delimits the branch 19 at the side opposite the flow deflecting surface 22 is positioned at an angle $\delta$ of 30 degrees to 60 degrees relative to the center plane 26. The flow deflecting rib 14 enables in this connection excellent adaptation of the intake angle and thus of the flow conditions in the cylinder interior 25.

Figure 5:
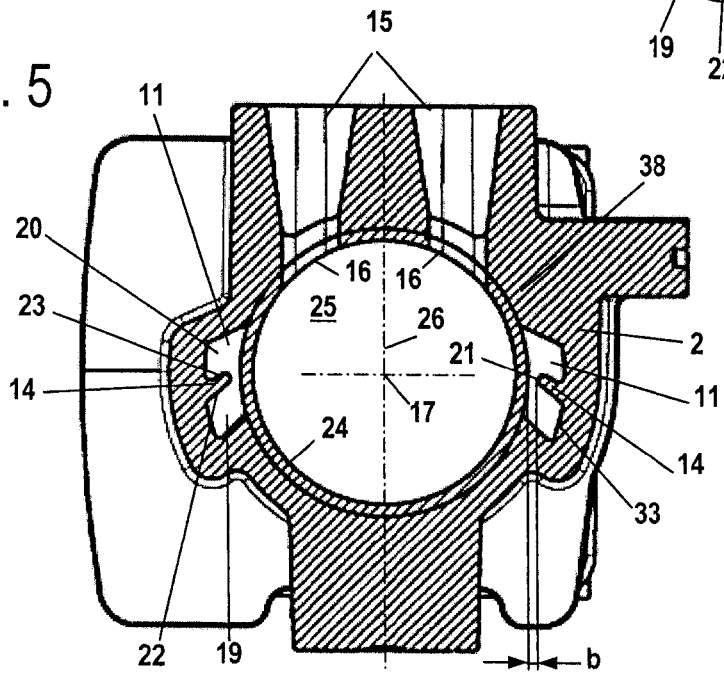
FIG. 5 is a section view along the section line V-V of FIG. 2.

The section illustration of FIG. 5 shows a section of the cylinder 2 below the transfer port 12 at the level of the air passage port 16. As shown in FIG. 5, in the cylinder wall 38 two branches of the air passage 15 are provided that extend on opposite sides of the center plane 26 approximately parallel to the center plane 26 and open with air passage ports 16 into the cylinder interior 25. The air passage ports 16 are provided in the cylinder lining 24. The flow deflecting rib 14 projects from the radially outwardly positioned wall 33 into the transfer passage 11 and divides the transfer passage into a branch 19 proximal to the exhaust 10 and a branch 20 remote from the exhaust 10. The flow deflecting rib 14 ends however at a spacing b in front of the cylinder lining 24 so that the two branches 19 and 20 of the transfer passage 11 are connected to one another by a gap between flow deflecting rib 14 and cylinder lining 24.

As illustrated in FIG. 6 in the section view at the level of the intake 9, the extension of the flow deflecting rib 14 in the radial direction relative to the longitudinal cylinder axis 17 decreases with increasing spacing away from the cylinder head 32. Accordingly, the edge 21 projecting into the transfer passage 11 has a spacing c to the cylinder lining 24 at the level of the intake 9 that is significantly greater than the spacing b. The flow deflecting rib 14 extends at this level across approximately one third of the radial depth of the transfer passage 11 measured radially relative to the longitudinal cylinder axis 17. A separation into two branches is no longer present at this level.

As shown in the section view of FIG. 7, below the intake 9 into the crank case 4 a flow deflecting rib 14 is no longer present. The transfer passages 11 are separated by the cylinder lining 24 from the cylinder interior 25.

FIG. 8 shows schematically a transfer passage 11 in a perspective illustration. Starting at the end of the transfer passage 11 proximal to the cylinder head 32, a flow deflecting rib 14 extends into the transfer passage 11 and divides the transfer passage 11 into the branch 19 near the exhaust 10 and into the branch 20 remote from the exhaust 10. The flow deflecting rib 14 extends across more than half of the length l of the transfer passage 11 measured parallel to the longitudinal cylinder axis 17. Expediently, the flow deflecting rib 14 extends across at least one third of the length l of the transfer passage 11. The flow deflecting rib 14 extends also across the entire height h of the transfer port 12. The branch 19 proximal to the exhaust 10 has at its end proximal to the cylinder head 32 a top wall 29 that opens at the transfer port 12 at an angle e relative to the longitudinal cylinder axis 17. The angle e is preferably at least 80 degrees, in particular approximately 90 degrees. The top wall 29 of the exhaust-proximal branch 19 of the transfer passage 11 extends planar. The top wall 30 at the end of the exhaust-remote branch 20 that is proximal to the cylinder head 32 extends at a radius r. At the transfer port 12 the top wall 30 is positioned at an angle d relative to the longitudinal cylinder axis 17 which angle d is preferably 25 degrees to 60 degrees. In FIG. 8, parallel lines to the longitudinal cylinder axis 17 are shown for the angles d and e. Moreover, the flow deflecting rib 14 can extend only across the height h of the transfer port 12. It is also possible to provide several flow deflecting ribs 14 in a transfer passage 11.

In FIG. 9, a cylinder interior 25 with transfer passages 11 and a cylinder lining 34 are schematically illustrated. The geometry before processing the seat for the lining is illustrated, i.e., overmeasure is shown. The cylinder lining 34 has a ring 35 that extends from the end facing the crank case 4 across a height g. The height g is preferably less than two thirds, in particular, less than half, of the length l of the transfer passage 11. In the area of the transfer passage 11, webs 36 are arranged on the ring 35 and extend at each transfer passage 11 parallel to the longitudinal cylinder axis 17 up to the bottom edge 31 of the transfer port 12. In this way, the transfer passage 11 is separated by the cylinder lining 34 from the cylinder interior 25 across its entire length l with the exception of the transfer ports 12. The top edge 37 of the web 36 forms the bottom edge 31 of the transfer port 12.

The arrangement of a flow deflecting rib 14 can also be expedient in the case of a transfer passage that is open toward the cylinder interior. In this case, the transfer port is the section of the transfer passage that is open toward the combustion chamber when the piston is at the bottom dead center. A flow deflecting rib 14 can also be expedient in the case of a transfer passage that is not separated by a cylinder lining 24 from the cylinder interior but is formed by means of cores in the wall of the cylinder when casting the cylinder. The flow deflecting rib 14 is cast as a monolithic part of the cylinder so that it can be produced in a simple way.

The specification incorporates by reference the entire disclosure of German priority document 10 2005 019 520.2 having a filing date of Apr. 27, 2005.

While specific embodiments of the invention have been shown and described in detail to illustrate the inventive principles, it will be understood that the invention may be embodied otherwise without departing from such principles.

What is claimed is:

1. A cylinder for a two-stroke engine, the cylinder comprising:

a cylinder wall defining a cylinder interior;

a cylinder head closing off a combustion chamber in the cylinder interior;

an exhaust connected to the cylinder interior;

at least one transfer passage disposed in the cylinder wall and having a transfer port opening into the cylinder interior, wherein the at least one transfer passage connects a crank case of the two-stroke engine to the combustion chamber;

the at least one transfer passage having at the level of the transfer port at least one flow deflecting rib that is spaced radially outwardly from the transfer port relative to a longitudinal cylinder axis;

wherein the at least one flow deflecting rib has a first end remote from the cylinder head and a second end proximal to the cylinder head, wherein the first end projects not as far into the at least one transfer passage as the second end so that a flow flowing in the at least one transfer passage from the crank case into the combustion chamber is divided gradually into two branches.

2. The cylinder according to claim 1, wherein the at least one transfer passage has a wall positioned radially outwardly relative to the longitudinal cylinder axis, wherein the at least one flow deflecting rib extends from said wall into the at least one transfer passage.

3. The cylinder according to claim 1, wherein the at least one flow deflecting rib is oriented in a direction of the longitudinal cylinder axis and has an edge projecting into the at least one transfer passage, wherein said edge extends at an angle relative to the longitudinal cylinder axis and said angle is defined by two intersecting lines tapering in a direction toward the cylinder head.

4. The cylinder according to claim 1, wherein the transfer port has a height measured in a direction parallel to the longitudinal cylinder axis and the at least one transfer passage has a length measured in a direction parallel to the longitudinal cylinder axis, wherein the at least one flow deflecting rib extends across the entire height of the transfer port and wherein the at least one flow deflecting rib extends about more than one third of said length of the transfer passage.

5. The cylinder according to claim 1, wherein the at least one flow deflecting rib divides the transfer passage into a first branch and a second branch and wherein the first and second branches are connected to one another.

6. The cylinder according to claim 5, wherein the first branch has a top wall positioned at a first angle measured in a radial direction relative to the longitudinal cylinder axis and wherein the second branch has a top wall positioned at a second angle measured in a radial direction relative to the longitudinal cylinder axis, wherein the first and second angles are different.

7. The cylinder according to claim 6, wherein the first branch is positioned proximal to the exhaust and wherein the first angle of the top wall of the first branch relative to the longitudinal cylinder axis is at least 80 degrees and wherein the second branch is remote from the exhaust and the top wall of the second branch extends at a radius and the second angle is 25 degrees to 60 degrees relative to the longitudinal center axis at which second angle the second branch opens into the cylinder interior.

8. The cylinder according to claim 1, wherein the at least one transfer passage has a wall that is remote from the exhaust and wherein said wall is positioned at an angle of 55 degrees to 75 degrees relative to a center plane dividing the exhaust at a level of the transfer port.

9. The cylinder according to claim 1, wherein the at least one flow deflecting rib has a first flow deflecting surface that is remote from the exhaust and a second flow deflecting surface that is proximal to the exhaust, wherein said first flow deflecting surface is positioned at an angle of 60 degrees to 115 degrees and said second flow deflecting surface is positioned at an angle of 35 degrees to 65 degrees, respectively, relative to a center plane dividing the exhaust at a level of the transfer port.

10. The cylinder according to claim 1, wherein the at least one transfer passage has a wall proximal to the exhaust and wherein said wall is positioned at an angle of 30 degrees to 60 degrees relative to a center plane dividing the exhaust at a level of the transfer port.

11. The cylinder according to claim 1, wherein the at least one flow deflecting rib is a monolithic cast part of the cylinder.

12. The cylinder according to claim 1, further comprising a cylinder lining disposed in a cylinder bore of the cylinder, wherein the cylinder lining separates the at least one transfer passage across at least a portion of a length of the at least one transfer passage from the cylinder interior, wherein the cylinder lining extends up to a bottom edge of the transfer port.

13. The cylinder according to claim 1, having two of said at least one transfer passage positioned opposite one another and symmetric to one another, wherein said two transfer passages each have one of said at least one flow deflecting rib.

14. The cylinder according to claim 1, further comprising at least one air passage that opens into a cylinder bore of the cylinder and supplies air through a piston recess into the at least one transfer passage.

15. A cylinder for a two-stroke engine, the cylinder comprising:

a cylinder wall defining a cylinder interior;

a cylinder head closing off a combustion chamber in the cylinder interior;

an exhaust connected to the cylinder interior;

at least one transfer passage disposed in the cylinder wall and having a transfer port opening into the cylinder interior, wherein the at least one transfer passage connects a crank case of the two-stroke engine to the combustion chamber;

the at least one transfer passage having at the level of the transfer port at least one flow deflecting rib that is spaced radially outwardly from the transfer port relative to a longitudinal cylinder axis:

a cylinder lining disposed in a cylinder bore of the cylinder, wherein the cylinder lining separates the at least one transfer passage across at least a portion of a length of the at least one transfer passage from the cylinder interior, wherein the cylinder lining extends up to a bottom edge of the transfer port and;

wherein the cylinder lining has an end facing away from the cylinder head and said end is a closed ring having a height that is less than two thirds of said length of the at least one transfer passage, and wherein the cylinder lining in the area of the at least one transfer passage has a web extending from said ring to the bottom edge of the transfer port and separating the at least one transfer passage from the cylinder interior.

16. The cylinder according to claim 15, wherein said height of said ring is less than half of said length of the at least one transfer passage.

17. A cylinder for a two-stroke engine, the cylinder comprising:

a cylinder wall defining a cylinder interior;

a cylinder head closing off a combustion chamber in the cylinder interior;

an exhaust connected to the cylinder interior;

at least one transfer passage disposed in the cylinder wall and having a transfer port opening into the cylinder interior, wherein the at least one transfer passage connects a crank case of the two-stroke engine to the combustion chamber;

the at least one transfer passage having at the level of the transfer port at least one flow deflecting rib that is spaced radially outwardly from the transfer port relative to a longitudinal cylinder axis;

wherein the at least one flow deflecting rib is oriented in a direction of the longitudinal cylinder axis and has an edge projecting into the at least one transfer passage, wherein said edge extends at an angle relative to the longitudinal cylinder axis and said angle is defined by two intersecting lines tapering in a direction toward the cylinder head.

* * * * *